US010820711B2

(12) United States Patent
Goldsmith

(10) Patent No.: US 10,820,711 B2
(45) Date of Patent: Nov. 3, 2020

(54) EXTENDED-RANGE VERSATILELY-CONFIGURABLE USER-ASSEMBLED ADJUSTABLE, AND HIGH-LOW ADJUSTABLE, BEDS

(71) Applicant: Aaron Goldsmith, Postville, IA (US)

(72) Inventor: Aaron Goldsmith, Postville, IA (US)

( * ) Notice: Subject to any disclaimer, the term of this patent is extended or adjusted under 35 U.S.C. 154(b) by 68 days.

(21) Appl. No.: 13/987,560

(22) Filed: Aug. 6, 2013

(65) Prior Publication Data

US 2015/0250323 A1 Sep. 10, 2015

(51) Int. Cl.

| | |
|---|---|
| ***A47C 19/04*** | (2006.01) |
| ***A47C 19/12*** | (2006.01) |
| ***A61G 7/012*** | (2006.01) |
| ***A61G 7/00*** | (2006.01) |

(52) U.S. Cl.

CPC ..... *A47C 19/045* (2013.01); *A47C 19/04* (2013.01); *A47C 19/12* (2013.01); *A61G 7/00* (2013.01); *A61G 7/012* (2013.01)

(58) Field of Classification Search

CPC ..... A47C 19/04; A47C 19/12; A61G 7/012; A61G 7/00

USPC ..... 5/611, 610, 613, 617, 618, 509.1

See application file for complete search history.

(56) References Cited

U.S. PATENT DOCUMENTS 272,077 A * 2/1883 Mueller ..... A47C 19/04 29/DIG. 102
2,367,266 A * 1/1945 Cooper ..... A47C 17/045 5/17
2,783,055 A * 2/1957 Michaud ..... B62B 3/0625 16/34
3,879,772 A * 4/1975 Pol ..... A61G 7/015 5/610
3,972,081 A * 8/1976 Stern ..... A61G 7/002 5/618
4,685,160 A * 8/1987 Rizzardo ..... A47C 19/005 5/201
4,901,383 A * 2/1990 Yang ..... A47C 27/085 403/205
4,970,737 A * 11/1990 Sagel ..... A47C 20/08 5/201
5,095,562 A * 3/1992 Alexander ..... A47C 20/041 5/611
5,347,682 A * 9/1994 Edgerton, Jr. ..... A61G 7/012 16/32

(Continued)

*Primary Examiner* — Peter M. Cuomo
*Assistant Examiner* — Ifeolu Adeboyejo
(74) *Attorney, Agent, or Firm* — Shuttelworth & Ingersoll, PLC; Jason Sytsma

(57) ABSTRACT

A high-low bed having a substantially rectangular upper surface is variably dynamically adjustable in elevation above a floor by action of a substantially planar substantially rectilinear upper frame presenting an upper surface to the bed, four stanchions of selectable length boltable at each of four opposing points under the upper frame, four swing arms hinge-connected at their first ends to the bottom of each of the four stanchions and at their second ends to wheels resting upon the floor. One or more motors move the swing arms about their hinged connection to the stanchions to variously elevate the upper surface of the bed above the floor. Nonetheless to its large height adjustment range, the entire bed breaks down to be shipped in two standard freight shipping boxes.

4 Claims, 11 Drawing Sheets

(56) References Cited

U.S. PATENT DOCUMENTS 5,418,987 A * 5/1995 Yoshino ..... A47C 19/045 5/11
5,438,723 A * 8/1995 Carroll ..... A47C 19/122 16/267
5,502,852 A * 4/1996 Fredman ..... A47C 19/024 248/188.4
5,579,550 A * 12/1996 Bathrick ..... A47C 19/005 5/184
5,669,090 A * 9/1997 Basgall ..... A61G 7/002 5/611
5,732,425 A * 3/1998 Leung ..... A61G 13/06 108/145
5,878,452 A * 3/1999 Brooke ..... A61G 7/012 5/428
5,894,614 A * 4/1999 Stroud ..... A47B 91/028 5/200.1
6,230,344 B1 * 5/2001 Thompson ..... A47C 19/045 5/611
6,357,065 B1 * 3/2002 Adams ..... A47C 19/04 5/611
6,360,386 B1 * 3/2002 Chuang ..... A61G 7/001 5/607
6,397,416 B2 * 6/2002 Brooke ..... A61G 7/0507 5/428
6,880,202 B2 * 4/2005 Thompson ..... A47C 19/024 16/35 R
6,957,456 B2 * 10/2005 Darling ..... A47C 19/045 5/509.1
6,990,698 B2 * 1/2006 Wall, Sr. ..... A47C 20/041 5/618
7,093,312 B2 * 8/2006 Mossbeck ..... A47C 20/041 5/600
7,913,335 B2 * 3/2011 Carr ..... A61G 7/012 5/11
8,117,696 B2 * 2/2012 Wernqvist ..... A61G 7/002 5/610
8,667,628 B1 * 3/2014 Heikkila ..... A47C 19/02 5/11
8,935,817 B2 * 1/2015 Suh ..... A47C 19/122 5/174
9,009,896 B2 * 4/2015 Suh ..... A47C 19/122 5/618
2004/0128765 A1 * 7/2004 Osborne ..... A61G 7/0528 5/600
2005/0172403 A1 * 8/2005 Darling ..... A47C 19/045 5/509.1
2006/0123545 A1 * 6/2006 Johnson ..... A61G 1/0562 5/611
2008/0052825 A1 * 3/2008 Wolff ..... A47C 19/005 5/201
2008/0250562 A1 * 10/2008 Tekulve ..... A47C 20/041 5/613
2009/0282616 A1 * 11/2009 Carr ..... A61G 7/012 5/611
2010/0229303 A1 * 9/2010 Goldsmith ..... A47C 19/005 5/285
2010/0302044 A1 * 12/2010 Chacon ..... A61F 5/56 340/575
2013/0247302 A1 * 9/2013 Chacon ..... G01V 3/088 5/613
2013/0312185 A1 * 11/2013 Su ..... A47C 20/043 5/618

* cited by examiner

EXTENDED-RANGE VERSATILELY-CONFIGURABLE USER-ASSEMBLED ADJUSTABLE, AND HIGH-LOW ADJUSTABLE, BEDS

REFERENCE TO RELATED APPLICATIONS

The present application is related as a Continuation in Part to U.S. patent application Ser. No. 12/381,444 for a MODULAR USER-ASSEMBLED ADJUSTABLE, AND HIGH-LOW ADJUSTABLE, BEDS, and to Ser. No. 12/381,445 for a MATTRESS RETAINER, both filed Mar. 11, 2009, and both to the selfsame inventor of the present application. The contents of the related patent applications are incorporated herein by reference.

BACKGROUND OF THE INVENTION

1. Field of the Invention

The present invention generally concerns adjustable beds where the contour of the upper surface of the bed is adjustable, and high-low adjustable beds that are adjustable in elevation above a floor as well as in contour.

The present invention particularly concerns adjustable, and high-low adjustable, beds that sell, ship, and assemble as modules.

2. Background of the Invention 2.1 the Relation of the Patent Applications

The first predecessor patent application for a MODULAR USER-ASSEMBLED ADJUSTABLE, AND HIGH-LOW ADJUSTABLE, BEDS teaches (1) an adjustable bed assembled from modular frame sections; (2) a structure, and a method, for attaching together plural sections of a modular adjustable bed so as to form an entire adjustable bed; (3) a user-assembled modular adjustable bed to which the user can selectively specify additional motors so as to realize the Trendelenburg position, the anti-Trendelenburg position, or the complete high-low elevation of the surface of the bed; and (4) a business method of shipping and delivering an adjustable bed to a user of the bed who subsequently erects the bed.

The second predecessor patent application for a MATTRESS RETAINER teaches a mattress retainer for a bed, more particularly an adjustable bed, and still more particularly a modular user-assembled adjustable bed. When used with a most-preferred user-assembled modular adjustable bed, the preferred embodiment of the mattress retainer is fully compatible with both (1) shipping of the modular sections of the adjustable bed, temporarily fitting most preferably in a reversed position about the same foot-region frame section to which it will ultimately mount to retain the mattress, and (2) user erection of the modular adjustable bed which can be realized—with the mattress retainer as well as with the rest of the bed—by one single person without use of tools.

The present application will be seen to concern a kit that can be assembled into a bed having an upper surface that is variably dynamically adjustable in height above two different base elevations above a floor, and the high-low adjustable bed so assembled. The bed is believed notable for, among other reasons, (1) presenting when lowered an extremely low bed height above a base that is necessarily compact, nonetheless to (2) permitting by judicious levered links that but modest and inexpensive electric motors should serve to elevate (upon the surface of the bed) a large person of weight up to 400 lbs. This high-low bed is further (3) contour adjustable. Still further, this high-low adjustable contour bed can be (4) completely sold and/or shipped and/or delivered as "cash and carry" merchandise, meaning that if may be purchased in modules that are contained in boxes from a store normally exhibiting a floor model of the bed, loaded in the purchaser's vehicle, and hauled away without further any involvement of the seller. Moreover, if shipped, then the bed can be so shipped at minimum cost in boxes that fit upon standard pallets, including as may be delivered by standard parcel services to an end item purchaser-erector-user of the bed. Finally, the modules of the bed may be selected by the purchaser to realize a number of different configurations, and functions of the bed.

This physical and functional modularity will be seen to be supported by clever construction and interconnection of selectable sections of the high-low adjustable bed which sections are, ultimately, connectable by nuts and bolts, and if having electrical parts, by standard electrical plugs and jacks. In summary, the modular high-low adjustable bed of the present invention will be seen to be related to the modular user-assembled adjustable, and high-low adjustable, beds, and to the mattress retainer, of the related predecessor inventions as a bed that, while preserving and even improving the modularity of its construction, is variably configurable, and very versatile.

2.1 Adjustable Beds

As reported in the entry "Adjustable bed" appearing in Wikipedia, the free encyclopedia of the Internet circa 2008, "[a]n adjustable bed is a bed which has a multi-hinged lying surface which can be profiled to a number of different positions. Common adjustment includes inclining the upper body and raising the lower body independently of each other. Other common features include height adjustment and tilting the bed to raise the upper body or the lower body into the Anti-Trendelenburg/Trendelenburg positions.

"Adjustable beds have been used in hospitals for a long time, but have become more commonly used in home care over the past three decades, as they have been found to provide relief from various conditions. Adjustable beds used in hospitals and home care are similar in basic functionality, however hospital beds must be able to withstand more rigorous and regular cleaning in order to reduce contamination and therefore any electrical bed components used in the hospital environment need to meet minimum waterproofing standards in order to withstand the cleaning process. Home care beds are less likely to be subjected to such intense cleaning, even if used within a care home, and this allows manufacturers to design beds whose aesthetics match home furnishings by using divan style beds or by using wooden veneer and laminates . . . .

"The increased popularity of motorized adjustable beds for home care is also partly due to the benefits provided to the care giver, by allowing them to work at a comfortable height and reduce the risk of back injuries. Height adjustment and raising the upper body also assists users in getting out of bed with little or no assistance dependent on their condition."

2.2.1 Trendelenburg and Anti-Trendelenburg Positions and Beds

In the Trendelenburg position the head is lower than the feet. In the anti-Trendelenburg position the feet are lower than the head. The head of a bed may be adjustable under force of a motor, and the base also, normally by a separate motor. A bed that may be elevated or depressed simultaneously in both its head and foot regions is called a "high-low bed". or, when adjustable, a "high-low adjustable bed", or, when fully motorized with up to four motors, "a motorized high-low adjustable bed".

Many beds, and motorized beds, and adjustable beds, and motorized adjustable beds, exist to realize these Trendelenburg and anti-Trendelenburg positions, which are variously useful in therapies for various afflictions. Specific beds are reviewed not for being of particular pertinence to the modular assemblable bed of the present invention but only so that it may be seen from these references that a fully motorized high-low adjustable bed is not a trivial example of mechanical engineering but is, indeed, a highly evolved and highly efficient and effective design.

2.3 Previous Adjustable Beds

U.S. Pat. No. 5,148,562 for a Birthing bed adjustable to Trendelenburg position concerns a birthing bed has a base, an intermediate frame mounted on the base with a power-actuated linkage to raise and lower the intermediate frame with respect to the base. A main frame is pivotally mounted on the intermediate frame so that it can be shifted from a horizontal position to an inclined Trendelenburg position. The intermediate frame is adapted to be lowered to bring the patient support surface to a very low level. In that level, the bed can be shifted to a Trendelenburg position with limit switches causing the intermediate frame to rise in order to accommodate the shift of the main frame to the inclined Trendelenburg position.

U.S. Pat. No. 3,722,010 for an ADJUSTABLE HOSPITAL BED INSTANTLY MOVABLE TO A TRENDELENBURG POSITION concerns a hospital bed having articulated head and foot elevation linkage systems that effect vertical movement of an upper horizontal frame, to which a mattress supporting structure is attached, with respect to a fixed lower horizontal frame. Rapid shifting to a trendelenburg position is achieved by providing, in the foot linkage system, an extendible segment having a pair of elongated links one of which is slidably and rectilinearly movable in the other. The segment may be quickly extended and locked, and by so doing the upper frame becomes tilted at a desired trendelenburg angle with its foot end raised relative to its head end.

U.S. Pat. No. 4,025,972 for an Elevating and Trendelenburg mechanism for an adjustable bed concerns an improved control and locking device for a hospital bed such as that disclosed in U.S. patent application Ser. No. 496,212, used to provide a positive lock of the hospital bed in a Trendelenburg or reverse Trendelenburg position and eliminate the capability to manually or inadvertently remove the bed from such position. As depicted herein, the locking device is a pivotal abutment which normally precludes release of a hook holding the bed in a Trendelenburg position. Yet, when the entire bed is raised by its electric motor, the abutment is automatically withdrawn from its abutting, locking position to permit the bed to lower under electric power.

U.S. Pat. No. 3,958,283 for an Elevating and Trendelenburg mechanism for an adjustable bed concerns an elevating and Trendelenburg mechanism for a hospital bed providing elevated Trendelenburg positions and positive latching of cooperating members. Two torque tubes pivotally attach to an elevating frame. Lift arms welded to the torque tubes support the frame at various elevations. A motor on the frame produces rotation of a yoke pivotally attached to one of the torque tubes. The yoke abuts a first drive arm rigidly attached to the tube to lift one end of the frame, and a second drive arm pivotally attached to the tube. A rod connects the second drive arm to a pivot plate as a second rod connects the pivot plate to a third drive arm welded to the other torque tube to lift the other end of the bed. When the frame raises to about its maximum height, one of two hooks on the frame may prevent the first or second drive arm from following a receding yoke, with the result that one end of the bed remains elevated while the other lowers. When not so engaged with the hooks, the second and third drive arms latch onto the yoke to prevent externally produced relative motion of the components.

2.4 Previous Modular Beds

Examples of ready-to-assemble or take-apart furniture is disclosed in U.S. Pat. No. 4,712,837 (Swilley); U.S. Pat. No. 5,605,378 (Oyediran); U.S. Pat. No. 5,992,938 (Jones); and U.S. Pat. No. 6,109,695 (Kahwaji).

U.S. Pat. No. 4,712,837 discloses a portable multipurpose chair that can be easily assembled and disassembled for transport storage and use. The chair components include right and left hand leg members, a seat member, a back member, an arm member having right and left hand arm portions joined by an interconnecting section, and a support member. The main components are planar and configured as an equilateral triangle or are based on an equilateral triangle. The components are formed with slots to interlock and connect one component to another. A back support includes dowel holes for a seat support and the sides include dowel holes at their apex for facilitating assembly. U.S. Pat. No. 5,605,378 discloses a "take-apart chair" comprising a seat, a pair of side pieces each having a back and seat support portion, a backrest and a brace member. The aforementioned pieces comprise hooks and notches designed for fixing them to each other in order to assemble the chair.

U.S. Pat. No. 5,992,938 describes items of furniture having interlocking parts formed of basic geometric shapes. In one embodiment a chair is formed of a circular back-support part, a triangular seat and square legs arranged parallel to each other. The parts are slotted to receive slots of equal depth formed in mating parts so that the assembled furniture item is strong and stable. The furniture is particularly intended to have aesthetic appeal and teach children about basic shapes, the art of design, and the art of construction.

U.S. Pat. No. 6,109,695 shows a chair assembly having detachably fitting parts. Vertically arranged right and left hand side chair supports include slots extending from the exterior profile of the first side support towards the center of the side support. A seat pan having extensions fits into two complementary slots of the right and left side supports. A back support having extensions also fits into two complementary slots of the right and left side supports. The seat pan and the back support may be independently adjusted so as to present various sitting positions.

International Application No. PCT/IL2007/000879 for ASSEMBLABLE FURNITURE relates to furniture intended for different uses such as a chair, an arm chair, a bed, an open cupboard, a stand, love-seat, sofa and the like. The structure shown and described is quire unlike the steel bed frame of the present invention, but similar requirements of strength, non-flexibility, safety and the like may be noted to be in common with the present invention. In the PCT application assemble-able furniture comprises a base (11) and a left side support part (14), a right side support part (15), a back part (12) and a front support part (13), each of said parts (12-15), not including the base (11), having a thickness and comprising two slots, said left side support part (14) and said right side support part (15) each comprising a front slot (50a; 50b) and a rear slot (40a; 40b), and said back part (12) and front support part (13) each comprising a right slot (30b; 60a) and a left slot (30a,-60b), each slot disposed and dimensioned to correspond to and fit with another slot and a portion of a corresponding part, each slot having a width being slightly-greater than the thickness of the portion of the part to which it corresponds upon assembly, wherein when the furniture is assembled, said parts mutually inter-fit at said slots to form a rectangular frame within which said base (11) rests; and said slots flare out at an angle such that said parts upwardly flare out when the furniture is assembled.

Most recently, United States patent application publication number 20070044235 for an Easily Assembled Bed Frame concerns a bed frame that can be assembled without the use of additional tools. The bed frame generally comprises a pair of spaced side rails, retainer brackets secured to each side rail, and cross support members extending between the side rails. Each retainer bracket has a base section for supporting one of the cross support members and an aperture extending through the base section. The apertures are aligned with threaded bores in the cross support members so that threaded portions of respective leg assemblies may be inserted through the apertures and used to secure the cross support members to the corresponding retainer brackets.

The "Minnen" extendable children's bed with iron bars of the IKEA company has proven to be a popular, but troubled, consumer product, Namely, the bed was pulled from the UK market after it was involved in the death of a 21-month-old girl. The children's bed involved was made on Aug. 24, 2008, Swedish furniture giant IKEA. A Nottinghamshire child strangled to death as she tried to retrieve a doll from the bed after waking from a nap, her head caught between the bed's iron bars, newspaper the Daily Mirror reports.

IKEA stopped the sale of the bed, named "Minnen" pending police investigation of the accident in Great Britain, but the model continued on sale in Scandinavia. IKEA Norway found no reason to believe there was a direct connection between the bed and the tragic accident in England, and the "Minnen" bed remained on sale In Norway.

IKEA has sold 58,000 "Minnen" beds around the world since their introduction in March 2005.

2.5 Previous Adjustable Beds that can be Conveniently Shipped

U.S. Pat. No. 6,990,698 to Wall, Sr. for a UPS-shippable adjustable articulating bed concerns an adjustable articulated bed with separate adjustable leg and head/back assemblies which support an articulating mattress. The bed is manufactured in three pieces specifically designed for economical shipping directly to consumers via United Parcel, FedEx or US Postal, and is easily assembled without-tools. The appearance of the bed is similar to that of a standard bed box spring or platform foundation and may be assembled and placed on a traditional metal frame, headboard, or footboard with side rails. Optional adjustable height legs are threadably attachable into support brackets connected to the bottom of each assembly to adjust the overall height of the bed. The three sections include a head support assembly with lifting arms pivotally attached to a head lifting frame and a deck panel attached thereatop to elevate the head and upper body; a leg support assembly with lifting arms pivotally attached to a two-part leg lifting frame with deck panels attached thereatop to elevate the legs; and a stationary center section supports the middle or buttocks area of the user. When the motor is attached between the leg and head support assemblies locking the assemblies together, the center section then slides into place there between. No tools, pins, clips or snaps are required for assembly.

Mentioned in the Background of the Invention section of this '698 patent are eight earlier U.S. patents. Those patents of some four inventors that appear to be most pertinent to the present invention seem to be:

U.S. Pat. No. 4,385,410 to Elliott, et al., disclose an articulated adjustable bed with a single motor which raises the first adjustable section and, through the linkage, the second adjustable section. Another adjustable articulated bed is disclosed by the same inventor in U.S. Pat. No. 5,870,784. Bathrick, et al., disclose articulated beds in U.S. Pat. Nos. 5,063,623 and 5,568,661.

U.S. Pat. No. 5,063,623 is directed to a power module for an articulated bed and the '661 patent is directed to an articulated bed with a modified standard frame supporting an independent power module. Palmer, Jr., et al., in U.S. Pat. No. 5,425,150, teach a device for converting a flat bed into an adjustable bed utilizing an articulating platform sandwiched between the box springs and the mattress.

And, finally, in U.S. Pat. No. 6,276,011 Antinori teaches an adjustable bed with a first frame and a second slide frame connected thereon. Although the goals of the present invention and the prior art particularly including the '698 patent are similar, the '698 patent, in particular and despite its Florida-based inventor, describes a system for an adjustable bed that is widely used in Europe. Although economical of construction, this system has, alas, proven to be flimsy and manifestly unsuitable for the larger people of the United States. Worse, the method and means of attaching the sections of the UPS SHIPPABLE ADJUSTABLE ARTICULATING BED of the '698 patent is neither particularly strong, nor rigid, and entire adjustable bed is rendered unstable by potential excessive motion, and even disconnection resulting from mechanical failure, between the preferred three sections of the adjustable bed.

The present invention will be seen to teach a system for connecting modular sections of an adjustable bed which system is very strong, and rigid, nonetheless to being assembled without tools, and particularly without such tools as might provide compressive connection, such as with and by the tightening of nuts and bolts.

2.6 The Rationale for an Modular Adjustable Bed

As explained in U.S. Pat. No. 6,990,698 to Wall, Sr. for a UPS shippable adjustable articulating bed, "Adjustable beds for comfort and therapy are extremely well known and provide support surfaces for a mattress which will incline the back/head of a user to any desired angle and will also separately incline the legs of the user for both comfort and therapeutic purposes. However, these articulated beds include mattress support or deck structure and motor driven power units which, in their assembled form, are extremely heavy and exceed all conventional economical shipping means available and therefore fall into categories of freight shipping costs which are substantially higher in shipping rates.

"The substantially higher . . . [f]reight charges can exceed $150 [circa 2006] and delivery and assembly costs for each adjustable twin bed, for example, weighing over 170 lbs. requires a two-man delivery team . . . . [Such additional costs can themselves approach the cost of a conventional bed frame, and exceed $300.00 U.S. circa 2013.]

"The popularity of adjustable beds increased when advertising programs became directed toward consumers with health or sleeping disorders or simply to recline while reading or watching television. Being manufactured primarily in conventional bedding sizes, the ease with which these inclining beds fitted into a bedroom situation [has] greatly increased usage.

"The construction of adjustable bed bases has changed very little over the past thirty years. Most adjustable bed bases are constructed with angle iron frames. A linear actuator lift motor is attached to pivotally connected lifting arms which independent raise and lower the head/back portion and segmented leg portions, typically moving about a stationary transverse mid torso or buttocks support area. A plywood or particle board deck with upholstered padding is attached to the lifting arms and decorative wood or laminate panels are applied to the sides of the exposed metal frame for a finished appearance . . . ."

SUMMARY OF THE INVENTION

The present invention has aspects of, and is embodied in, (1) an adjustable bed assembled from modular frame sections; (2) a structure, and a method, for attaching together plural sections of a modular adjustable bed so as to form an entire adjustable bed; (3) a user-assembled modular adjustable bed to which the user can selectively specify additional motors so as to realize the Trendelenburg position, the anti-Trendelenburg position, or the complete high-low elevation of the surface of the bed; and (4) a business method of shipping and delivering an adjustable bed to a user of the bed who subsequently erects the bed.

Particularly as regards the shipping and delivering of the bed, the bed may be sold as "cash and carry" merchandise, meaning that if may be purchased in boxes from a store normally exhibiting a floor model of the bed, loaded in the purchaser's vehicle, and hauled away without further any involvement of the seller. Moreover, if shipped, then the bed can be so shipped at minimum cost in boxes that fit upon standard pallets, including as may be delivered by standard parcel services to an end item purchaser-erector-user of the bed.

1. An Adjustable-Height-Bed Kit with Boltable Stanchions for Height Adjustability Above a Floor In one of its aspects the present invention is embodied in an adjustable-height-bed kit with boltable stanchions for height adjustability above a floor.

In the preferred high-low bed a substantially rectangular upper surface is variably dynamically adjustable in elevation above a floor. This preferred adjustable-elevation-bed includes (1) a substantially planar substantially rectilinear upper frame presenting an upper surface to the bed; (2) four stanchions boltable at each of four opposing points under the upper frame to extend vertically downwards from the bottom of the bed's substantially rectilinear upper frame, to a hinged connection to a swing arm; (3) four swing arms hinge-connected at their first ends to the bottom of each of the four stanchions; connected at their second ends to (4) four wheels mounted to second ends of the four swing arms and resting upon the floor; and (5) one or more motors to move the swing arms about their hinged connection to the stanchions to variously elevate the upper surface of the bed above the floor. The height of the vertically extending stanchions contributes to the height that the upper surface of the bed may be variously elevated above the floor under force of the motors.

Notably in this structure the stanchions are bolted.

Moreover, the four stanchions are preferably selectable from a stanchions having at least two different lengths before being assembled by bolting to (1) the bottom of the bed's upper frame, and to (2) the swing arm. The longer stanchions serve to elevate the upper surface of the bed higher above the floor, while the shorter stanchions serve to elevate the upper surface of the bed lower above the floor.

The utility of this boltability, and this selectability, is that different high-low beds may be easily assembled by bolting from a common inventory of piece parts.

2. A Kit for a Bed Having an Upper Surface that is Variably Dynamically Adjustable in Height Above Two Different Base Elevations Above a Floor In another, similar, one of its aspects the present invention is embodied in a kit that can be assembled into a bed having an upper surface that is variably dynamically adjustable in height above two different base elevations above a floor.

The adjustable-height-bed kit includes (1) elements assemblable into a bed frame defining an upper surface; (2) four stanchions selected from either of (a) a first, relatively shorter, type, or of (B) a second, relatively longer type, that bolt to and under the bed frame so as to define the four corners of an imaginary rectangle, the relatively-shorter and the relatively-longer stanchions respectively positioning the frame and its upper surface (A) at a first, relatively lower, base elevation, or (B) at a second, relatively higher, base elevation, above a floor; and (3) a lift mechanism including two motors each operating through a lever arm to dynamically elevate the frame above, and higher than, its preselected base elevation upon stanchions of either preselected type.

The lever arm itself is preferably adjustable in lineal extent (1) so as to assume a first, relatively shorter, length that permits the fame having the first-type stanchions to assume the first, relatively lower, base elevation, or (2) so as to assume a second, relatively longer, length that permits the fame having the second-type stanchions to assume the second, relatively higher, base elevation.

Thus by both (1) selection of the stanchions, and (2) adjustment of the length of the lever arm of the lift mechanism, the kit can be assembled into either an adjustable-height bed capable of dynamically assuming adjustable heights above (A) a first, relatively lower, base elevation above the floor, or, alternatively, (B) a second, relatively higher, base elevation above the floor.

In the high-low bed kit the lever arm is preferably adjustable in lineal extent by a bolting of pieces.

Further in the kit those elements assimilable into the bed frame that defines the upper surface are packaged and delivered to a site whereat the bed frame is assembled in but essentially two packages, each package containing essentially one-half of the frame and upper surface of the bed, these two halves of the bed frame being strongly connected together by two elongate linear connection members each of which slides within two opposing hollow tubular members of and on each half of the bed frame.

The kit still further preferably includes an electrical vibrator for imparting vibration to the upper surface of the bed.

3. A Minimal Bed Frame for Supporting a Substantially Rectangular Adjustable Surface for a Contour Adjustable Bed In yet another of its aspects the present invention is embodied in a minimal bed frame for supporting a substantially rectangular adjustable surface for a contour adjustable bed.

The Minimal Bed Frame Includes (1) a Plurality of Planar Small-Rectangle Frame Elements that Fit to one another all in a single plane so as to establish a large-rectangle planar frame upon which an adjustable bed surface can be erected; (2) four legs that removably affix to, and extend downwards from, the small-rectangle frame elements at each of the four corners of the large-rectangle planar frame formed by the fitted frame elements; (3) a fifth leg that removably affixes to, and extends downwards from, one of the small-rectangle frame elements; and (4) a lifter bar, hinged to the fifth leg in the leg's downwards extension and connected to a foot panel of the bed, but selectively elevating the foot panel of the adjustable bed.

Notably each of the (1) plurality of planar small-rectangle frame elements, (2) the four legs, (3) the fifth leg, and (4) the lifter bar, are, before affixation to each other, are of total thickness no greater than the steel channel of plate from which they are made, and can thus be packaged and shipped together in a package that is dimensionally thin.

In this minimal bed frame the number of frame elements is preferably two; these two frame elements connecting to each other to form the large-rectangle planar frame because a linear extension of one element slides into a complimentary bore of the other element.

4. A Bed that is Variously Selectively Configurable so as to be at Least One of (1) High-Low Height Adjustable (1A) at the Feet, or (1B) at the Head, or (2) Contour Adjustable (2A) at the Feet, or (2B) at the Head In another of its aspects the present invention is embodied in a bed that is variously selectively configurable so as to be at least one of (1) high-low height adjustable (1A) at the feet, or (1B) at the head, or (2) contour adjustable (2A) at the feet, or (2B) at the head. This is realized by selection and interconnection of a limited number of interchangeable parts from which a bed of particular height and particular contour configuration is constructed.

The variably-configurable bed includes (1) one partitioned multi-part upper surface suitable for beds of all configurations; (2) one frame suitable to hold and support the upper surface of beds of all configurations; (3) four stanchions selected of either a first, relatively shorter, type, or of a second, relatively longer, type that bolt to the underside of the frame in the corners of a rectangular pattern so as to respectively support the frame at and in a relatively lower, and a relatively higher, base elevation above a floor; (4) two or one or zero lift motors of a same type that respectively act through two or one or no elevation mechanisms so as to respectively position the foot and the head of the frame, or the foot or the head of the frame, or neither the foot nor the head of the frame, relatively higher and lower in height above the floor and above the base elevation of the bed, which elevating motion when present is called a "high-low bed"; (5) four stanchions of a selected one of two types, being (A) a first, relatively shorter, type, or (B) a second, relatively longer type, that serve to respectively position the frame of the bed at a first, relatively lower, base elevation, or at a second, relatively higher, base elevation above a floor; and (6) two or one or zero elevation mechanisms of two mirror-image types that respectively connecting the two or the one or the zero lift motors to the frame so as to respectively elevate the foot and the head of the frame, or the foot or the head of the frame, or neither the foot nor the head of the frame, relatively higher and lower in height above the floor, and above the base elevation (these elevation mechanisms are mirrors of each other save for one part called a pivot arm which pivot arm part is relatively shorter if the stanchions are of the first, relatively shorter, type, or which part is relatively longer if the stanchions are of the second, relatively shorter, type); (7) two or one or zero contour adjustment motors of a same type as respectively act through the two or the one or the no elevation mechanisms so as to respectively adjust both the foot and the head portions of the upper surface, the foot or the head portion of the upper surface, or neither portion of the upper surface, which adjusting motion if present is called an "adjustable bed"; and (8) two or one or zero contour-adjusting mechanisms to two mirror image types that respectively connect the two or the one or the zero lift motors to the frame so as to respectively elevate the foot and the head portions of the frame, or the foot or the head portion of the frame, or neither the foot nor the head of the frame, to be relatively higher and lower. All selected parts to configure the variously high-low adjustable, contour-adjustable, bed are either identical, or are mirror images of each other, save only the stanchions and the pivot arm, and these parts are variably adjustable in length.

In this variously configurable high-low-adjustable contour-adjustable bed the pivot arm is preferably adjustable in length by the bolting together of elongate pieces.

5. Summary of the Various Aspects of the Present Invention

The predecessor invention taught that a high-low, an adjustable, or a high-low adjustable bed might be broken down—most particularly in its top surface upon which a mattress and a sleeper are supported—into modular assemblies that may be both (1) shipped within the standard size (and weight) standards of commercial freight carriers, and/or (2) conveniently transported by vehicle after a "cash and carry" sale, and/or (3) hand assembled by amateurs.

The present invention teaches that several beds of differing (1) size and height configuration, and/or (2) functionality, may be built by (A) selection between and among a limited number of common parts, coupled with (B) bolted hand assembly.

A new era in modular, and modularity functional, non-hospital home-use high-low adjustable beds is presented.

These and other aspects and attributes of the present invention will become increasingly clear upon reference to the following drawings and accompanying specification.

DESCRIPTION OF THE PREFERRED EMBODIMENT

Figure 1:
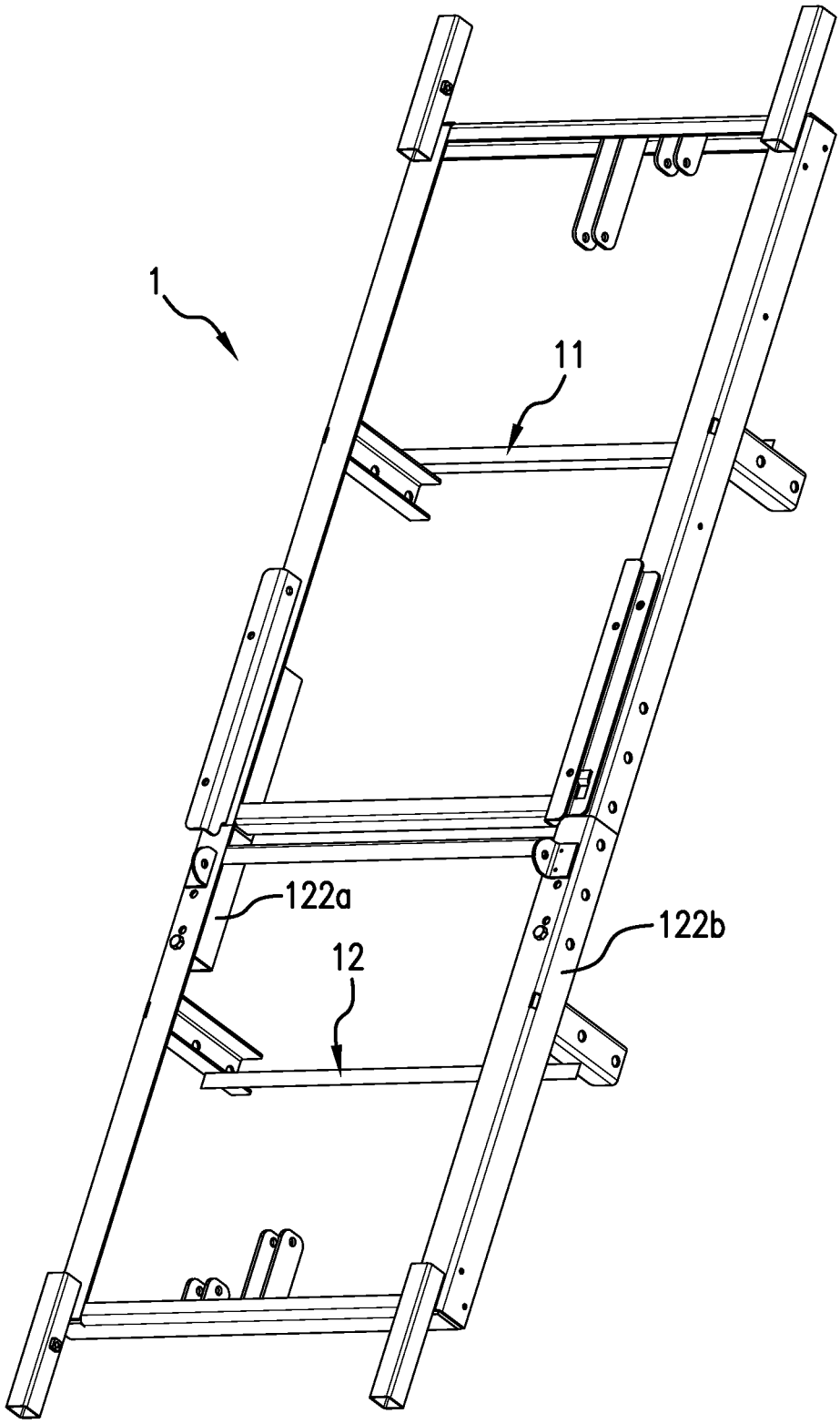
FIG. 1 is a diagrammatic perspective view of a base portion of a preferred embodiment of the modular adjustable bed of the present invention, the portion being without motors and wiring.
Figure 2:
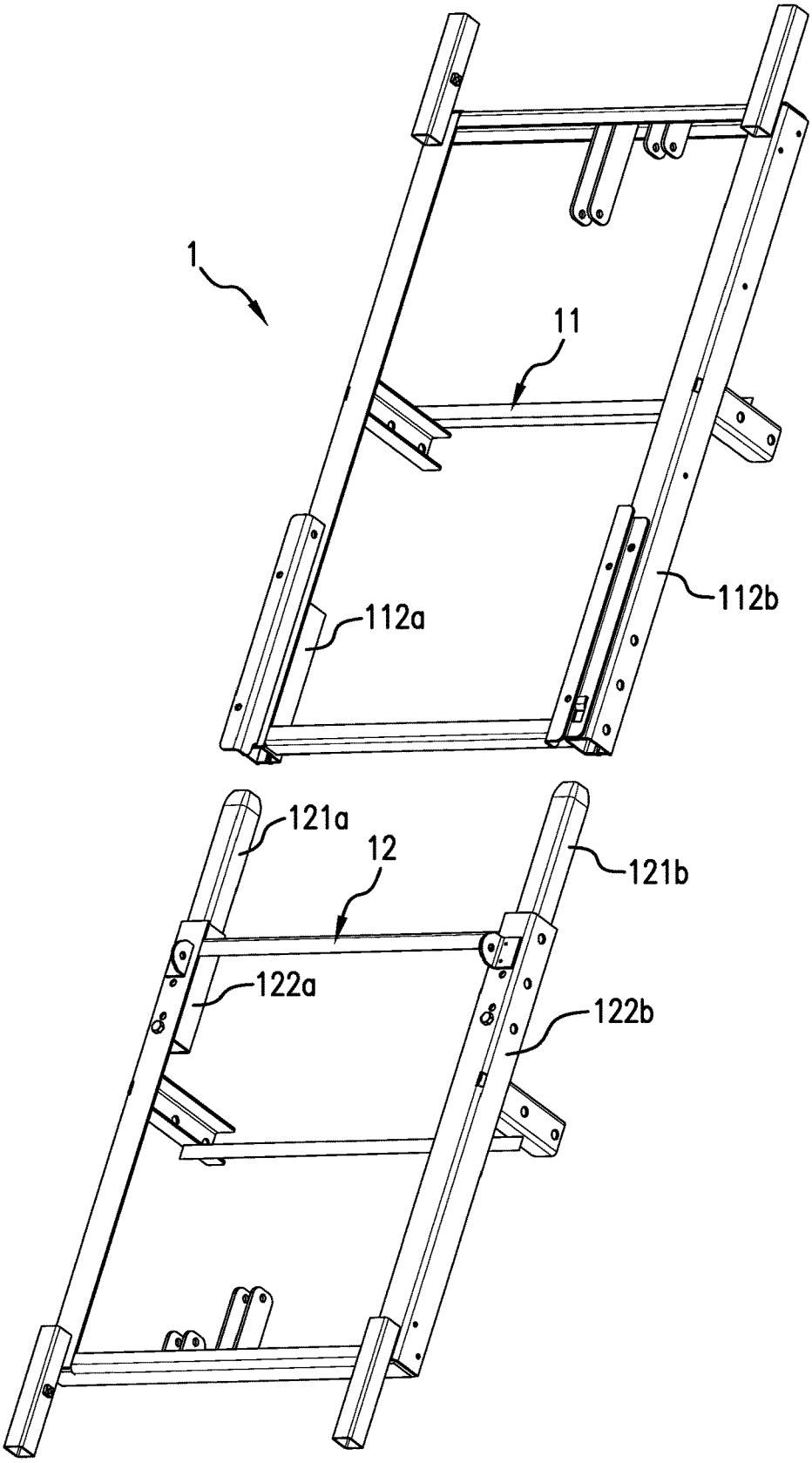
FIG. 2 is a diagrammatic perspective view of the base portion of the preferred embodiment of the modular adjustable bed of the present invention, previously seen in FIG. 1, now split into it head and foot sections that are each boxed and shipped separately, and later assembled together by a purchaser-user without use of tools.

A diagrammatic perspective view of base portion 1 of a preferred embodiment of a modular adjustable bed of the present invention, this base portion 1 being shown being without associated motors and wiring, is contained in FIG. 1. Another diagrammatic perspective view of this same portion 1, now split into a head section 11 and a foot section 12 (that are each boxed and shipped separately, and later assembled together by a purchaser-user without use of tools) is shown in FIG. 2. The portion 1 is substantially constructed of square cross section steel tube. Various attachment points are presented at which the pivoting bed surfaces, and the motors, of the adjustable bed may be conventionally attached.

In accordance with the present invention, two bull-nosed inner tubes 121*a*, 121*b* (best seen in FIG. 2) extend from spaced-parallel foot frame section 12 towards corresponding cavities in the complimentary spaced-parallel frame rails 112*a*, 112*b* of the head frame section 11. The protruding inner tubes 121*a*, 121*b* slide longitudinally into the opposed cavities of the head frame section frame rails 112*a*, 112*b*, semi-permanently joining the two, head and foot, frame sections 11, 12. The fit is snug, and the connection strong, but the union may readily be accomplished under force of the hands and arms of an adult man.

Figure 3A:
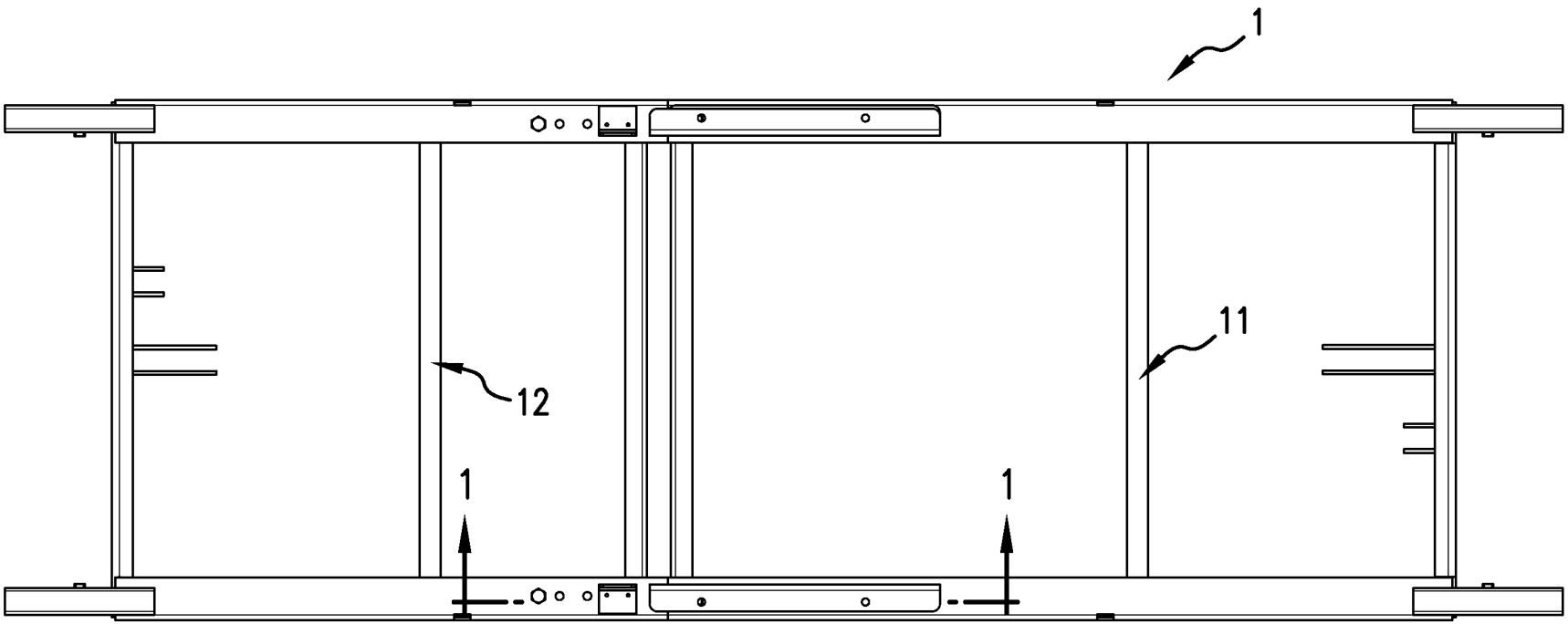
FIG. 3, consisting of FIG. 3*a* and FIG. 3*b*, are detailed plan views showing the telescoping attachment mechanism of the heat and foot sections of the partial preferred embodiment of the modular adjustable bed of the present invention, previously seen in FIGS. 1 and 2.
Figure 3B:
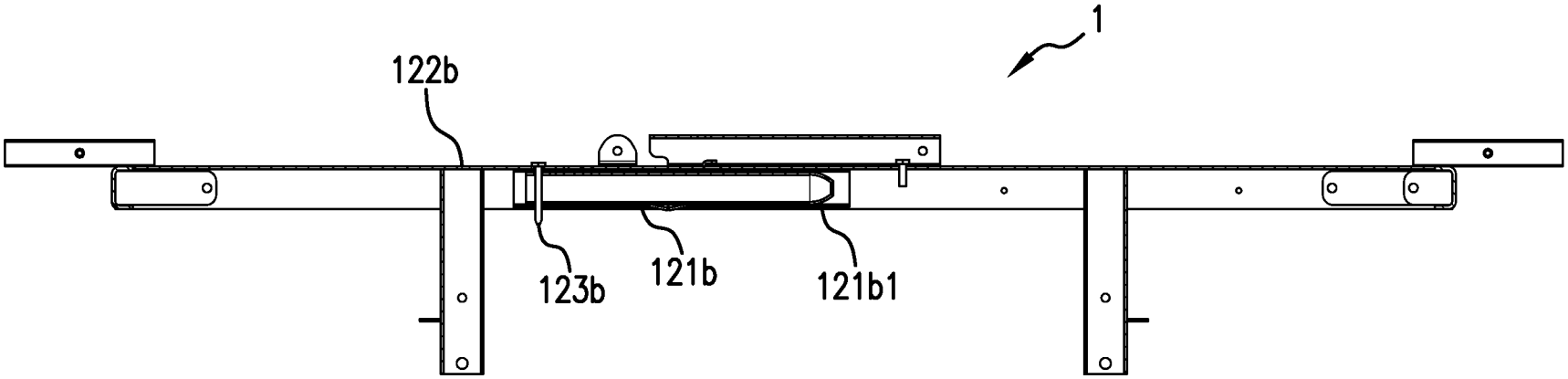

Detailed plan views showing the telescoping attachment mechanism of the head and foot sections 11, 12 of the partial preferred embodiment of the modular adjustable bed of the present invention are shown in FIGS. 3*a* and 3*b*. FIG. 3*b* is a cut-away cross sectional view taken along aspect line 1-1 of FIG. 3*a*.

A plastic nose—of which nose 121*b* of inner tube 121*b* is shown—on each of the inner tubes 121*a*, 121*b* serves to guide each tube into the cavity of head section frame rail tubes 112*a*, 112*b*. A bolt, of which bolt 123*b* shown in FIG. 3*b* is exemplary, may be dropped into holes that become aligned upon sliding connection of the frame rails, therein to strongly hold the sections together. All bolts may be removed from dis-assembly.

The head and foot sections 11, 12 of the base of the preferred embodiment of the modular adjustable bed of the present invention are the largest sections of the bed. Other parts and sections, such as the planar sections that comprise the sleeping surface of the bed, the motors for the bed and their wiring harness, and the controls for the bed, are all smaller, and lighter, than are the head and foot sections 11, 12. Moreover, it is the interlocking between the head section 11 and the foot section 12 that, in particular, provides strength, stability, and durability to the adjustable bed. Accordingly, the gravamen of the present invention will be found within the quality affixation and union, achieved without tools, of the head and foot sections 11, 12, and it will be understood that beds and adjustable beds of standard design may readily be affixed to the illustrated modular base by practitioners of the design of mechanical beds.

Figure 4A:
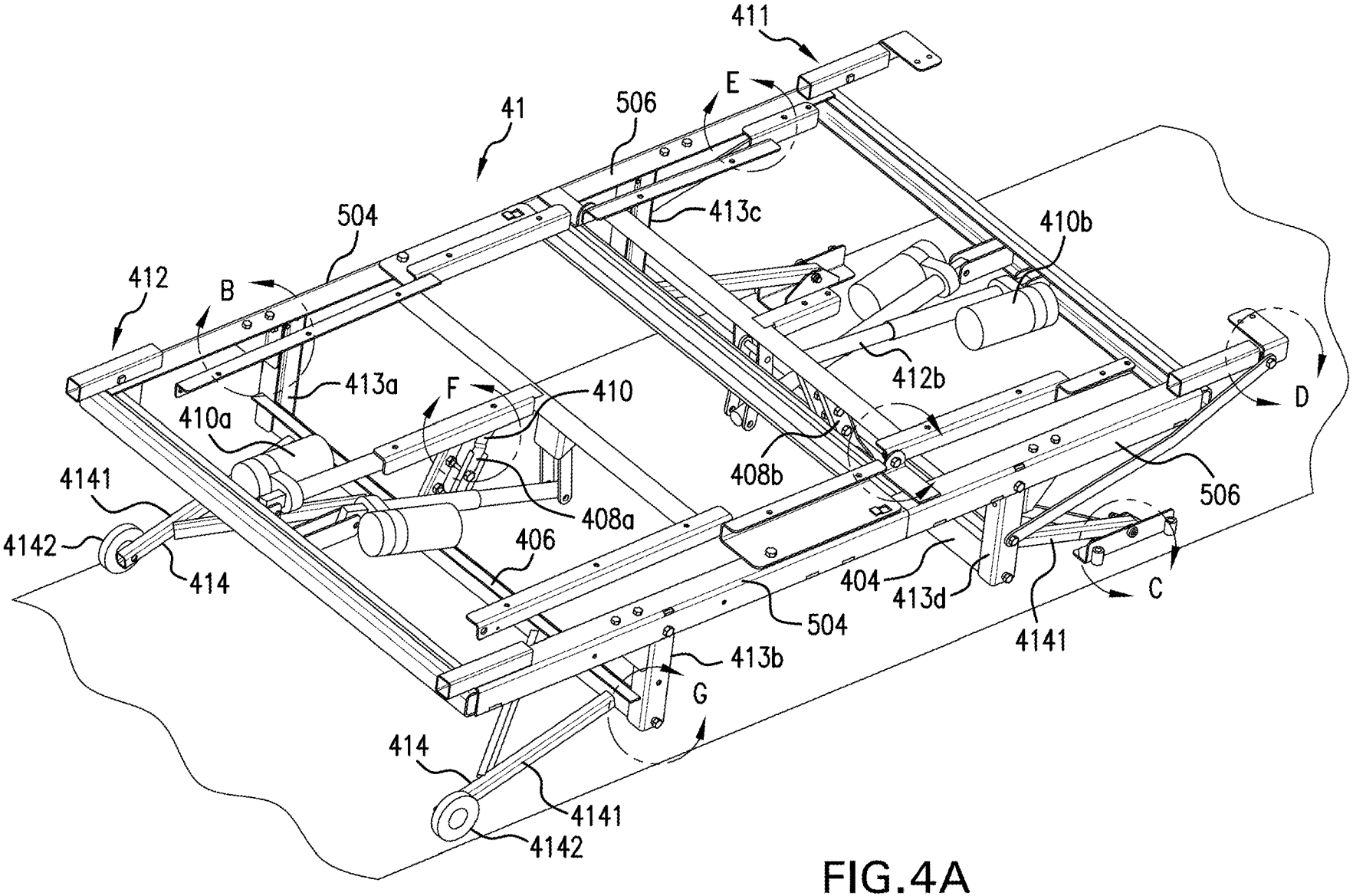
FIG. 4*a* is a diagrammatic perspective view of an assembled frame of a second preferred embodiment of the modular adjustable bed of the present invention, the frame being capable of being split into it head and foot sections that are each boxed and shipped separately, and that are later assembled together by a purchaser-user without use of tools.

A diagrammatic perspective view of an assembled frame of a second preferred embodiment of the modular adjustable bed of the present invention is shown in FIG. 4*a*. The frame 41 is capable of being split into it's head section 411 and its foot section 412. Each section 411, 412 is, as before with the first preferred embodiment, boxed and shipped separately, and later assembled together by a purchaser-user without use of tools. The union is by tubes where one fits snug within another, as before with the first embodiment of the bed seen in FIGS. 1-3.

Notable in the second embodiment of the frame 41, four stanchions 413*a*-413*d* are purchaser-user selectable from among at least two included groups of four stanchions each group having at least two different lengths. By this choice presented, one set of four stanchions 413 may be selected and bolted during assembly of the frame 41 to basically determine the height of the frame above the floor. The longer set of stanchions 413*a*-413*d* serve to elevate the upper surface of the bed higher above the floor, while the shorter set of stanchions serve to elevate the upper surface of the bed lower above the floor.

Also notable in the second embodiment of the frame 41, a pivoting lift mechanism operating through one or two elevation mechanisms—of which a single foot section elevation mechanism 414 is partially shown in FIG. 4*a*—serves to respectively position the foot and the head of the frame, or the foot or the head of the frame, or neither the foot nor the head of the frame, relatively higher and lower in height above the floor and above the base elevation of the bed. This elevating motion is called a "high-low bed". The pivoting arms 4141 of the (single) elevation mechanism 414 terminate in wheels 4142.

A lift motor (not shown in FIG. 4*a*; shown in FIG. 5) operates to pivot the elevation mechanism 414 so as to respectively position the foot and the head of the frame, or the foot or the head of the frame, or neither the foot nor the head of the frame, relatively higher and lower in height above the floor and above the base elevation of the bed. If two elevation mechanism are included, each is the mirror of the other save for possibly differing lengths of pivot arms 4141 (illustrative), and is preferably independently controlled. If two elevation mechanism are included, each normally, and preferably uses the same type of motor, and motor control (not shown in FIG. 4*a*, shown in FIG. 5). Indeed, all selected parts to configure the variously high-low adjustable, contour-adjustable, beds having the second embodiment frame 41 are either identical, or are mirror images of each other—save only the stanchions 413 and the pivot arms 414) and even these parts are only of but differing lengths.

The utility of this boltability, and selectability, is that different high-low beds may be easily assembled by bolting from a common inventory of piece parts.

Figure 4B:
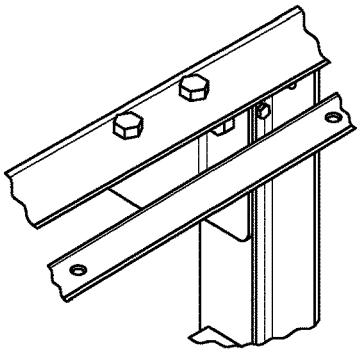
FIG. 4*b* is a detail view of area B of the frame of the second preferred embodiment of the modular adjustable bed of the present invention previously shown in FIG. 4*a*.
Figure 4C:
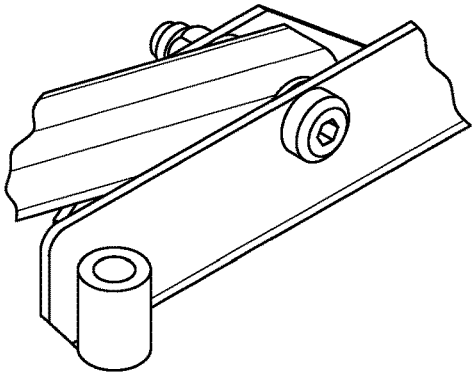
FIG. 4*c* is a detail view of area C of the frame of the second preferred embodiment of the modular adjustable bed of the present invention previously shown in FIG. 4*a*.

A detail view of area B of the frame of the second preferred embodiment frame 41 of the modular adjustable bed of the present invention is shown in FIG. 4*b*, a detail view of area C in FIG. 4*c*, a detail view of area D in FIG.

Figure 4D:
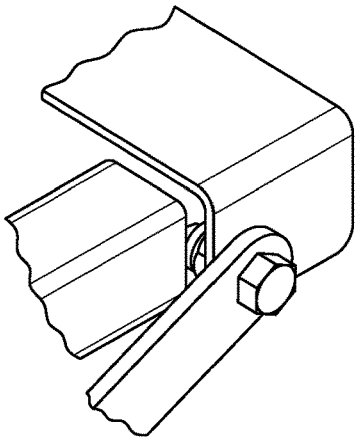
FIG. 4*d* is a detail view of area D of the frame of the second preferred embodiment of the modular adjustable bed of the present invention previously shown in FIG. 4*a*.
Figure 4E:
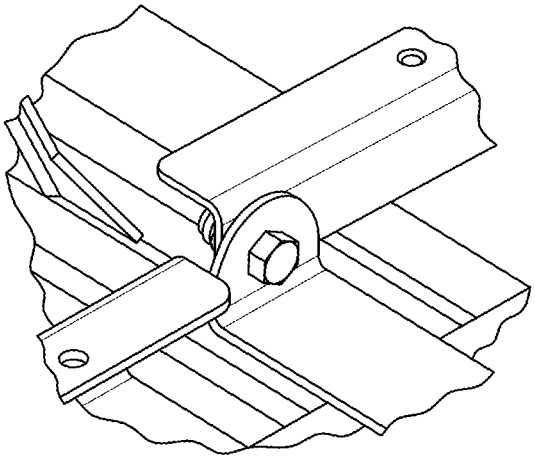
FIG. 4*e* is a detail view of area E of the frame of the second preferred embodiment of the modular adjustable bed of the present invention previously shown in FIG. 4*a*.
Figure 4F:
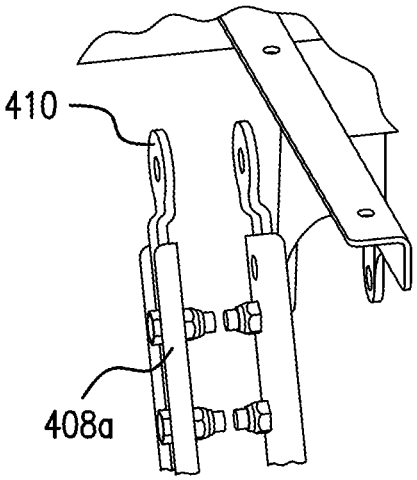
FIG. 4*f* is a detail view the lever arm of area F of the frame of the second preferred embodiment of the modular adjustable bed of the present invention previously shown in FIG. 4*a*.
Figure 4G:
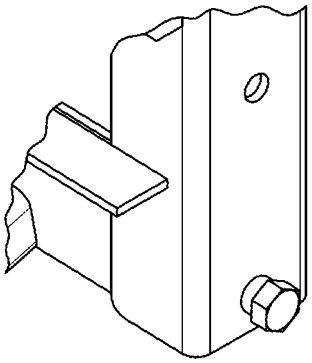
FIG. 4G is a detailed view of area G in FIG. 4A.

4*d*, a detail view of area D in FIG. 4*d*, a detail view of area E in FIG. 4*e*, a detail view of area F in FIG. 4*f*, and a detail view of area G in FIG. 4*g*. The basic showing of the detail views is that everything to assemble the second embodiment frame 41 connects by bolts, and by hand without any necessity of tools.

Figure 5:
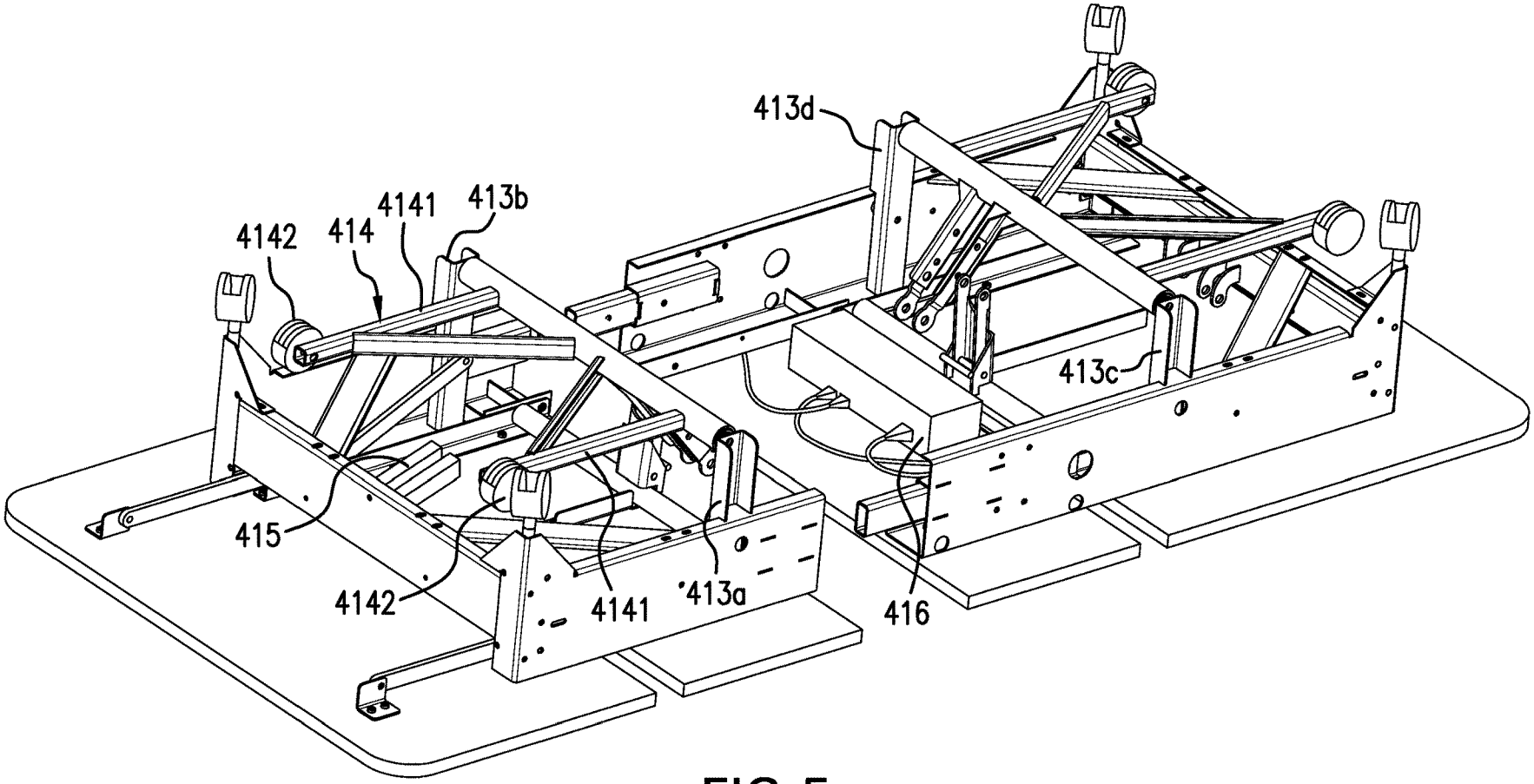
FIG. 5 is a diagrammatic perspective view of the second preferred embodiment of the modular adjustable bed of the present invention in an inverted position.

A diagrammatic perspective view of the second preferred embodiment frame 41 of the modular adjustable bed of the present invention is again shown, now in an inverted position, in FIG. 5. Stanchions 413*a*-413*d*, the pivot arm assembly 414 including pivot arms 4141 and wheels 4142, all previously seen in FIG. 4*a* are again visible. Now shown is a motor 415 and a motor controller 416.

That the four stanchions 413*a*-413*d* are boltable at each of four opposing points under the upper frame to extend vertically downwards from (1) the bottom of the bed's substantially rectilinear upper frame, to (2) a hinged connection to a swing, or pivot, arm 414 is clearly shown. Likewise that two, of a possible four, swing, or pivot, arms 4141 are (1) hinge-connected at their first ends to the bottom of each of the four stanchions 413*a*, 413*b*, and are (2) connected at their second ends to two wheels 4142 (out of a possible four wheels if two pivot arm assemblies 414 are used one at each end of the bed) is clearly shown. The wheels 4142 of course rest upon the floor when the frame 41 is in its normal, use, position (inverted from the way it is shown in FIG. 5).

In studying the construction of the second embodiment frame of FIG. 5 it should always be remembered that not only is maximum versatility of function realized by selection and assembly of common parts, but the entire extended-range versatilely-configurable user-assembled adjustable, and high-low adjustable, bed of the present invention breaks down to be shipped in but two standard shipping containers, and handled—including for tool-free hand assembly—by but one single man.

Figure 4H:
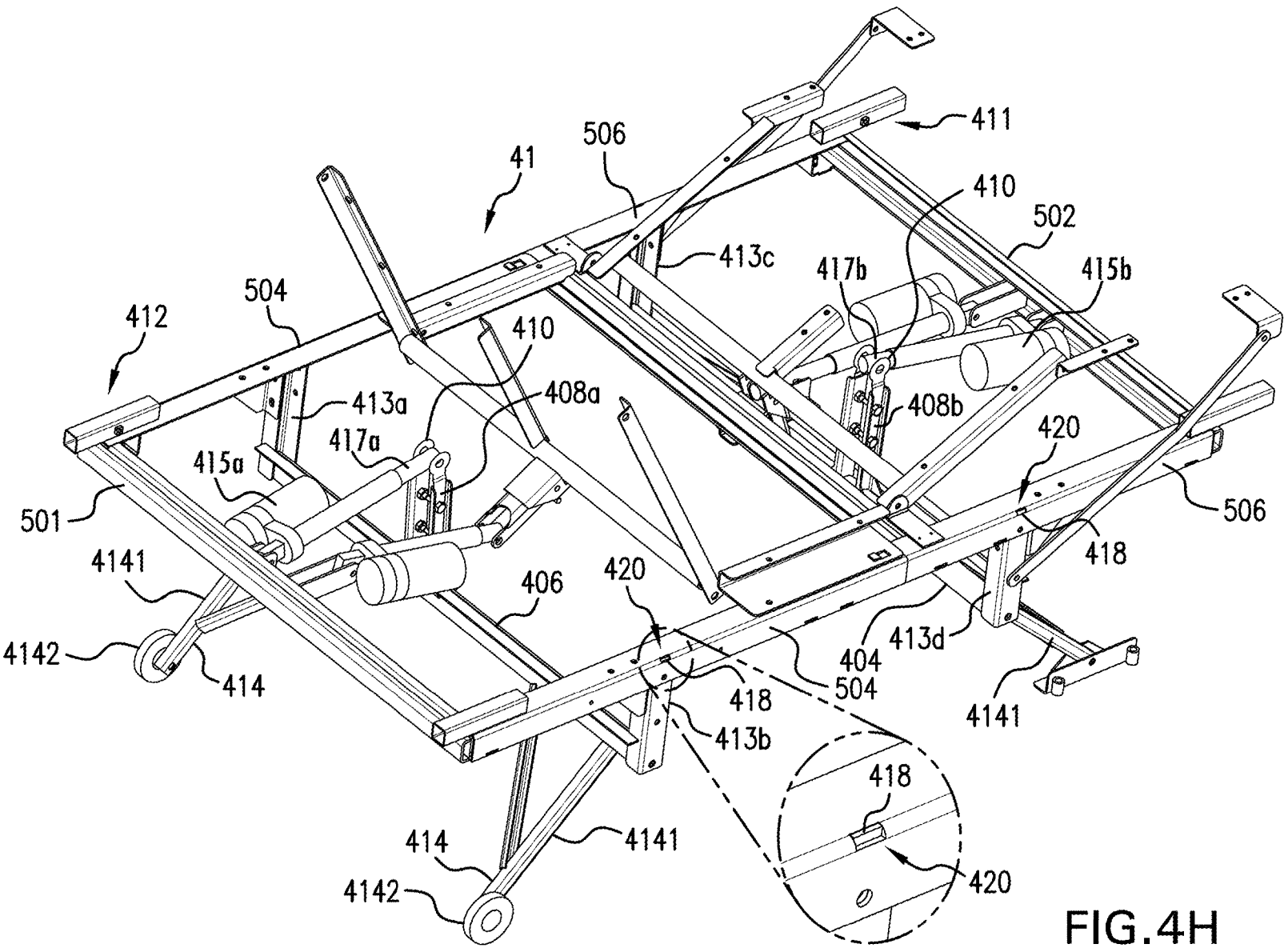
FIG. 4H is a diagrammatic perspective view of the modular adjustable bed shown in FIG. 4A with the frame in the upright position.
Figure 4I:
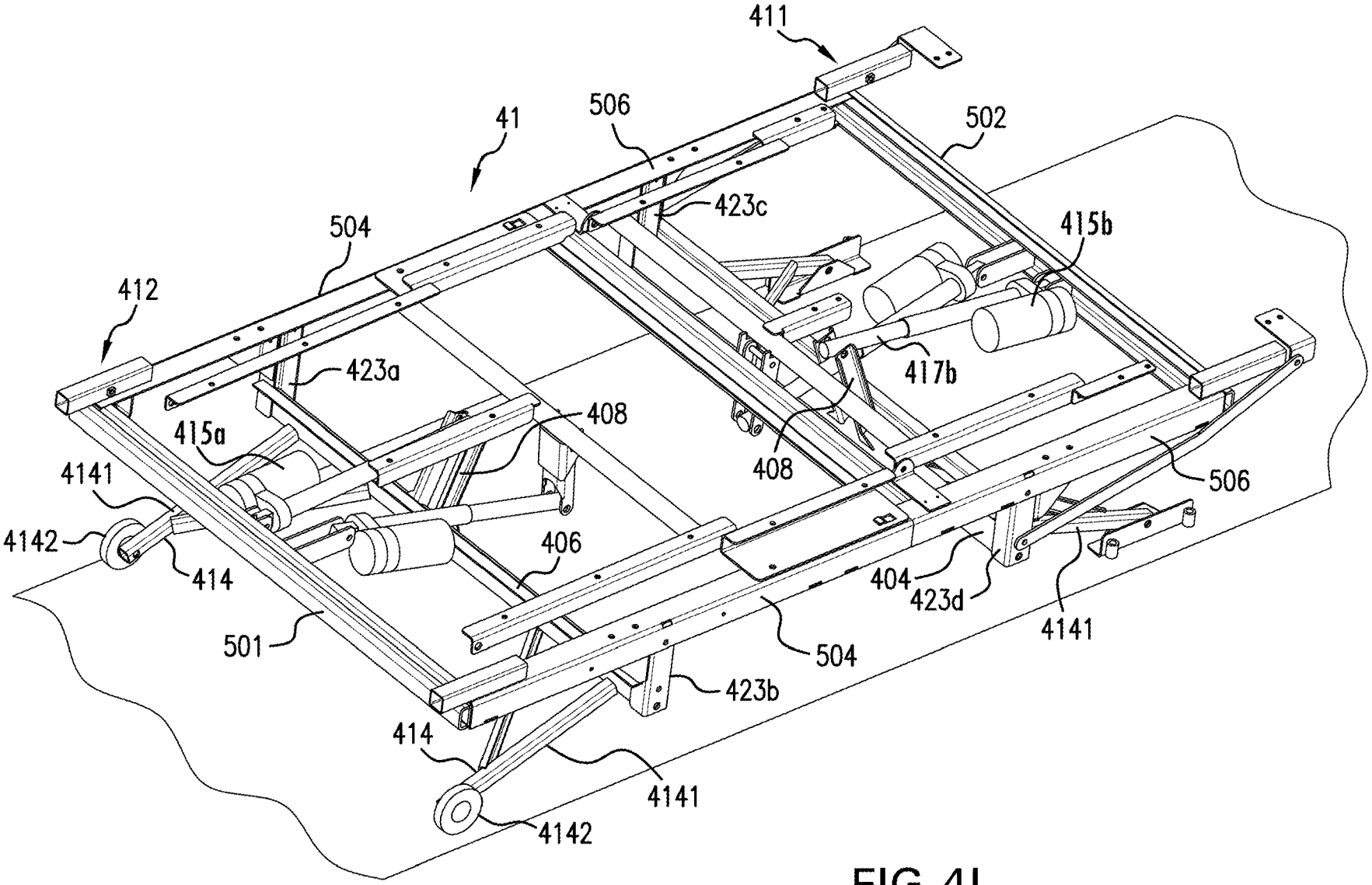
FIG. 4I is a diagrammatic perspective view of the modular adjustable bed shown in FIG. 4A with the frame in the declined position and the longer set of stanchions of FIGS. 4A and 4H replaced with the shorter set of stanchions and the extension member removed from the member on each of the head section and the foot section.
Figure 4J:
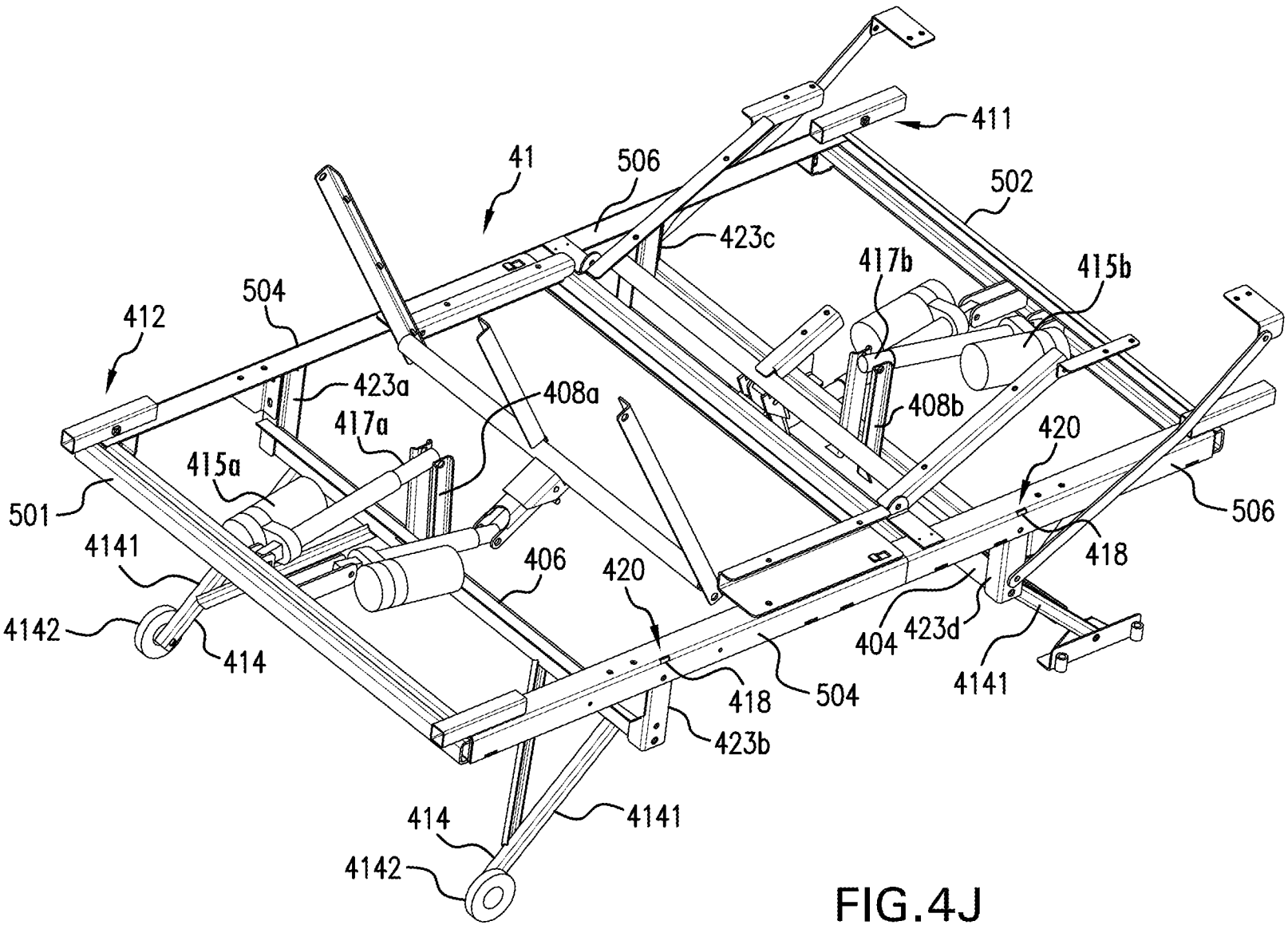
FIG. 4J is a diagrammatic perspective view of the modular adjustable bed shown in FIG. 4I in the inclined position.

The frame 41 of the modular adjustable bed of the present invention is shown in FIGS. 4A, 4H, 4I, and 4J. The modular adjustable bed of the present invention is provided with two stanchion sets 413(*a*-*d*) and 423(*a*-*d*) to adjust the height of the frame off of the floor to create a high profile configuration (FIGS. 4A and 4H) or a low profile configuration (FIGS. 4I and 4J). In the high profile configuration a boltable extension member 410 attaches to respective lever arms 408*a*, 408*b* (a close up view is shown in FIG. 4F) to increase their linear length.

Turning first to the high profile configuration of FIGS. 4A and 4H, a longer set of stanchions 413*a*-*d* is combined to the bottom of the frame 41 to position the frame 41 higher off of the floor. An extension member 410 is added to each of lever 408*a* on the foot section 412 of the frame and to lever arm 408*b* on the head section 411 of the frame. Turning next to the low profile configuration of FIGS. 4I and 4J, a shorter set of stanchions 423*a*-*b* is combined to the bottom of the frame 41 to position the frame 41 closer to the floor. Extension member 410 is removed from each of lever arm 408*a* on the foot section 412 of the frame 41 and from lever arm 408*b* on the head section 411 of the frame 41.

In each of the high profile configuration and the low profile configuration, the axle 406 of foot section 412 and axle 404 of the head section 411 are combined to the respective stanchions 413(*a*-*d*) and 423(*a*-*d*). This means that in the low profile configuration, the axle 406 of foot section 412 and axle 404 of the head section 411 is positioned closer to the bottom of the deck. This requires extension member 410 to be removed from each of lever arm 408*a* on the foot section 412 of the frame 41 and from lever arm 408*b* on the head section 411 of the frame 41, as shown in FIGS. 4I and 4J, to prevent the respective extension members 410 from hitting the bottom of the deck when frame 41 is raised and lowered.

In operation, for the high profile configuration shown in FIGS. 4A and 4H, motor 417*a* and motor 417*b* are each attached to frame 41. Their respective piston 417*a* and piston 417*b* are attached to extension members 410 which are bolted to the respective lever arm 408*a* and 408*b*. Lever arm 408*a* is attached to axle 406 and lever arm 408*b* is attached to axle 404. Each axle 404 and axle 406 has attached a pair of pivoting arms 4141, so that rotation of axle 404 and axle 406 rotates the respective pair of pivoting arms 4141.

In operation, for the low profile configuration shown in FIGS. 4I and 4J, motor 417*a* and motor 417*b* are each attached to frame 41. Their respective piston 417*a* and piston 417*b* are attached to respective lever arm 408*a* and 408*b*. Because shorter set of stanchions 423*a*-*b* are used in this configuration, the respective axle 404 and axle 406 are closer to the bottom of the deck (shown in FIG. 5). If extension members 410 are not removed from each of lever arm 408*a* and 408*b* to shorten its perpendicular distance from the axis of rotation defined by the respective axle 406 and axle 404, the extension members will collide with the bottom of the deck.

According to these variations, and still others within the skill of a practitioner of the art of design of mechanical beds, and adjustable beds, and modular adjustable beds, the present invention should be considered in accordance with the following claims, only, and not solely in accordance with that particular embodiment within which the invention has been taught.

What is claimed is:

1. A high-low bed comprising:

a rectangular frame including a head section including two longitudinal rails separated by a lateral member, and a foot section including two longitudinal rails separated by a lateral member, the two longitudinal rails of the head section and the two longitudinal rails of the foot section are selectively combinable so that the head section and the foot section can be separated for transport;

wherein the rectangular frame is configurable in a low profile configuration and a high profile configuration, wherein in the high profile configuration, the rectangular frame further comprises:

four stanchions in a first set of stanchions are each attachable to one of four positions under the frame to position the frame above a floor;

a first axle extending crosswise between two stanchions on the head section and a second axle extending crosswise between the two stanchions on the foot section;

a first lever arm connected to the first axle and an extension member is attached to the first lever arm and a second lever arm connected to the second axle and an extension member is attached to the second lever arm, wherein the first lever arm and the second lever arm are adjustable in lineal extent by a bolting of the extension member to the first lever arm and a bolting of an extension member to the second lever arm;

a pair of pivoting arms each attached to the first axle wherein rotation of the first axle rotates the pair of pivoting arms to raise or lower one end of the frame with respect to a floor; and a pair of pivoting arms each attached to the second axle, wherein rotation of the second axle rotates the pair of pivoting arms to raise another end of the frame;

a first motor combined to the frame at one end and the extension member at the other end, which extension member is combined to the first lever arm which is combined on the first axle, wherein movement of the extension member and the first lever arm by the first motor rotates the first axle to raise or lower the head section of the frame with respect to the floor; and a second motor combined to the frame at one end and combinable to the extension member at the other end, which extension member is combined to the second lever arm that is combined on the second axle, wherein movement of the extension member and the second lever arm by the second motor rotates the second axle to raise or lower the foot section of the frame with respect to the floor; and wherein in the low profile configuration, the four stanchions in a second set of stanchions replace the four stanchions in the first set of four stanchions and are each attachable to one of four positions under the frame to position the frame closer to the floor; and the first motor is attached directly to the first lever arm that is combined to the first axle to decrease a stroke of the first motor and the second motor is attached directly to the second lever arm that is combined to the second axle to decrease a stroke of the second motor.

2. The high-low bed of claim 1, wherein the four stanchions are one of a first stanchion set and a second stanchion set, wherein the four stanchions in the first stanchion set are longer than the four stanchions in the second stanchion set, and wherein the first axle and the second axle are each combinable to a pair of stanchions in one of the first stanchion set and the second stanchion set to change a height of the first axle and the second axle from the floor.

3. The high-low bed of claim 1, wherein the head section further comprises two sleeves each including a cavity with one of the two sleeves on each of the two longitudinal frame rails; wherein the foot section further comprises two sleeves each including a cavity with one of the two sleeves on each of the two longitudinal frame rails; and a floating inner tube with a nose for each of the two sleeves in one of the head section and the foot section and the floating inner tube is movable between a first position retracted in the cavity of the sleeve and a second position extending from the cavity of the sleeve with the nose of the floating inner tube guiding the floating inner tube into the sleeve, wherein the nose is a bull-nose shape and the floating inner tube is articulatable in a transverse and lateral manner within both the sleeve for the foot section and the sleeve for the head section to guide the floating inner tube into the corresponding sleeve to combine the foot section and the head section, and the floating inner tube is movable between a first position retracted in the cavity of the sleeve and a second position extending from the cavity of the sleeve.

4. The high-low bed of claim 2, wherein the second stanchion set is attachable to the frame with the extension member connected to the member of the first axle and the extension member connected to the member of the second axle to lower the rectangular frame closer to the floor and reposition the first motor and the second motor so that they do not hit the floor.

* * * * *